US005938535A

United States Patent [19]

King

[11] Patent Number: 5,938,535

[45] Date of Patent: Aug. 17, 1999

[54] PROTECTED CABLE FOR PLAYGROUND SWING

[75] Inventor: Steven G. King, Maple Plain, Minn.

[73] Assignee: Landscape Structures Inc., Delano, Minn.

[21] Appl. No.: 08/938,229

[22] Filed: Sep. 26, 1997

[51] Int. Cl.[6] ..... A63T 9/12

[52] U.S. Cl. ..... 472/118; 16/111 R

[58] Field of Search ..... 472/118, 119, 472/120, 121, 122, 123, 124, 125; 16/111 R, 114 R

[56] References Cited

U.S. PATENT DOCUMENTS

| | | | |
|---|---|---|---|
| 1,340,904 | 5/1920 | Medart | 472/118 |
| 4,575,073 | 3/1986 | Thacker | 472/118 |
| 5,197,925 | 3/1993 | Cunard | 472/118 |
| 5,197,926 | 3/1993 | Cunard | 472/118 |
| 5,216,780 | 6/1993 | Lutzke et al. | 472/118 X |
| 5,337,449 | 8/1994 | Lutzke | 16/111 R |

*Primary Examiner*—Kien T. Nguyen
*Attorney, Agent, or Firm*—Merchant & Gould P.C.

[57] ABSTRACT

A device is disclosed for suspending a playground swing seat from an overhead support. The device comprises a length of stranded steel cable having a relatively small diameter with first and second connecting means at each end taking the form of an annular bushing with the cable looped around the bushing and secured by a ferrule. A swing handle formed from resilient material and having a diameter of about 1 inch is molded onto the lower end of the steel cable. The remaining length of the steel cable and both bushings are encapsulated by a molded resilient coating that has a diameter of about 5/16 inch.

19 Claims, 2 Drawing Sheets

PROTECTED CABLE FOR PLAYGROUND SWING

The invention is directed to an improved suspension cable for playground swings.

Commercially produced playground equipment is subject to various regulations and standards the purpose of which is to ensure that the equipment is as safe for children to use as it is entertaining.

Playground swings are among the types of playground equipment subject to such regulations and standards. In particular, ASTM F1487 of the American Society for Testing and Materials (ASTM) requires that components designed for hand grasping shall have a transverse diameter of 0.95 inches–1.55 inches to provide an acceptable gripping surface. The recommended guidelines of the Consumer Product Safety Commission (CPSC) pertaining to playground swings include similar requirements.

Chain easily complies with these standards and guidelines, and it is the most popular material currently used on commercially produced playground swings. However, chain is not comfortable for children to hold because of its link structure and the resulting irregular configuration. Chain may also be uncomfortable to hold in extremely hot or cold weather conditions.

Many swing manufacturers have solved this problem by surrounding the chain with a length of resilient tubing made from materials such as polyvinylchloride (PVC). While this alleviates the problem to some extent, swing chains so encapsulated are still uncomfortable for children's hands due to the irregularity in external shape and resulting discomfort. Further, the tubing covers only the chain itself and not the bearings and associated hardware for connecting the chain to the overhead support or the swing seat, and these components are therefore subjected to weather elements that may adversely affect long term function.

Stranded steel cable is a potential substitute for chain because of its significant tensile strength, but unlike chain its use with a diameter of one inch or more creates problems of weight, cost and lack of flexibility. If smaller diameter cable were used, it would provide sufficient tensile strength and flexibility, but also would present an insufficient handle surface for the child to grip. For these reasons, smaller diameter cable does not comply with applicable standards and regulations of the ASTM and CPSC.

Further, the individual strands of stranded steel cable have a tendency to break with time and increased wear, and the resulting strand ends that project from the cable surface are sharply pointed and may cut or penetrate small hands. For these reasons, stranded steel cable has not been successfully used on commercially produced playground swings.

This invention is the result of an endeavor to develop an improved device for suspending commercially produced playground swings, and in particular to develop a substitute for chain that exhibits sufficient strength characteristics without its attendant problems.

The invention utilizes stranded steel cable of sufficient diameter as to provide more than adequate tensile strength for the intended function while providing sufficient flexibility as well. The preferred size is about 3/16 inches in diameter, which has a tensile strength of approximately 4,000 pounds.

While this diameter is too small to provide a sufficient gripping configuration, I have found that a resilient material such as PVC can be molded onto the cable with a large diameter sufficient for children to easily grip. As indicated above, dipping the cable into liquid PVC will produce a resilient and protective surface, but dipping will not produce a handle portion of the thickness required for compliance with ASTM standards and CPSC regulations. Molding can be accomplished by placing the cable in a vertical mold, gravity filling the mold with liquid the PVC and allowing PVC to cure. Portions of the cable remote from the handle portion may be molded with a smaller diameter. In addition, it is possible to encapsulate the connecting bushings at each end of the cable.

The inventive swing cable provides more than adequate strength and flexibility while offering a large diameter resilient handle portion which even small children may easily grip. Molding the bushings and associated hardware at each end of the cable avoids the presentation of sharp surfaces. Further, the molded PVC offers sealed protection from environmental elements such as temperature extremes, rain and snow.

DESCRIPTION OF THE PREFERRED EMBODIMENT

Figure 1:
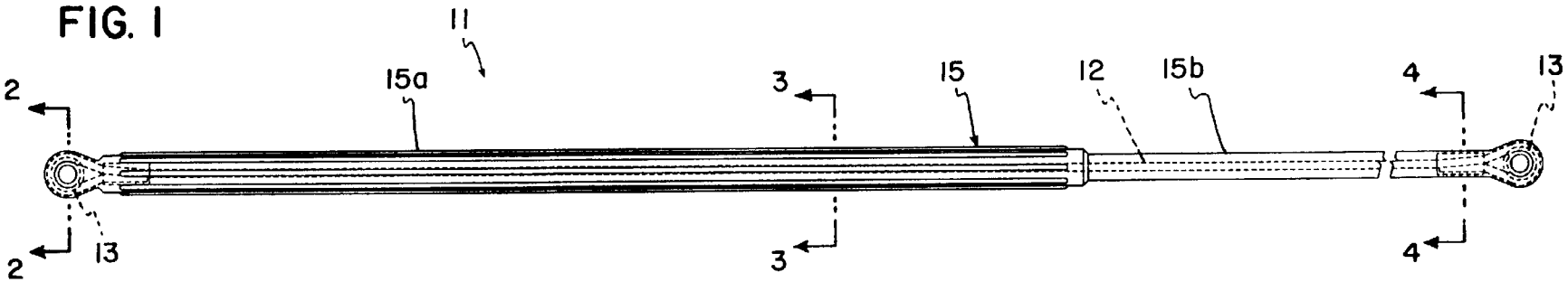
FIG. 1 is a fragmentary side elevation of a swing supporting cable embodying the invention.

With initial reference to FIGS. 1–4, an improved device for suspending a playground swing from an overhead support is represented generally by the numeral 11. The device 11 includes at its core an elongated member 12, preferably flexible, and having a transverse configuration which is relatively small; i.e., it is relatively difficult to grip by a swing user due to its size. The elongated member has a tensile strength of sufficient magnitude to safely suspend the swing during a range of normal and expected uses given the relatively small size of the transverse configuration. In the preferred embodiment, the elongated member is stranded steel cable having a substantially circular cross section configuration the preferred diameter of which is 3/16 inch. Stranded steel cable having a 3/16 inch diameter has a breaking strength of approximately 4,000.

The upper end of the cable is connected to an overhead support which will be discussed in further detail below. The lower end is connected to one side of a swing seat, also as discussed in further detail below.

To facilitate these upper and lower connections as well as to ensure proper operation of the swing, an annular bushing is connected to each end of the cable 12. In the preferred embodiment, the bushing is formed from bronze and has a 7/16 inch inside diameter enabling it to be connected with a pivot pin as described in further detail below.

Figure 4:
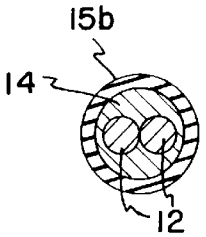
FIG. 4 is an enlarged transverse sectional view taken along the line 4—4 of FIG. 1.

The external periphery of each of the bushings 13 is grooved to receive the cable (see FIGS. 1 and 2), and the bushing is connected by encircling the bushing 12 with a free end of the cable 12 so that the free end lies adjacent the main cable body. As shown in FIG. 4, a ferrule 14 is placed over the adjacent portions of the cable 12 and forced toward the bushing 13 to lock it in place and maintain the cable end in this locked position.

With a bushing 13 assembled at each end of the cable 12 as shown in FIG. 1, a resilient coating represented generally by the numeral 15 is molded onto the entirety of the cable assembly. The preferred material for the coating 15 is resilient polyvinylchloride (PVC), although other materials can be used. This molded coating includes a thicker handle portion 15*a* that extends from a point proximate the lower cable end to a second point that is sufficiently high relative to the swing seat as to provide a handle or gripping portion to swing users of varying ages and sizes. For example, the handle portion 15*a* may be about two feet in length.

Figure 3:
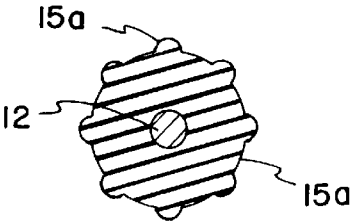
FIG. 3 is an enlarged transverse sectional view taken along the line 3—3 of FIG. 1.
Figure 2:
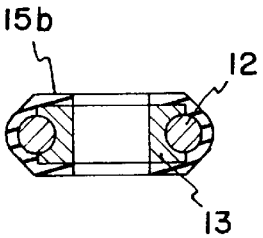
FIG. 2 is an enlarged transverse sectional view taken along the line 2—2 of FIG. 1.

With reference to FIGS. 1 and 3, the handle portion 15*a* is generally circular but includes a plurality of elongated ribs 15*c* extending over substantially the entire length of handle portion 15*b*. The ribs are semicircular in configuration and present a comfortable gripping surface for the handle portion 15*a*. The external diameter of handle portion 15*a* is preferably one inch, which is comfortable for swing users of varying ages. This size also complies with Standard 14-87 of the American Society of Testing and Materials.

The remaining portion 15*b* is molded on the remainder of the cable 12 and also completely encompasses the connecting assemblies at each cable end. This molded coating encapsulates the bushing 13, the free end of cable 12 and ferrule 14 (see FIGS. 2 and 4). The preferred outside diameter of the molded cable as shown in FIG. 4 is ⅝ inches. To accomplish this, the overall thickness of the coating 15*b* ranges from about 0.2 inches to about 0.4 inches.

Because of the thickness of the handle portion 15*a* of coating 15, it cannot be dipped as is conventional with coated swing chains. It has been found that the most efficient manner of encapsulating the cable assembly with the coating 15 is by molding. This is accomplished by first plugging the bore of each of the bushings 13 and orienting the cable assembly vertically. The cable assembly is enclosed within a mold cavity, then liquid PVC is injected into the mold until it is filled. After the PVC has cured into a resilient solid form, the part is removed, and the assembled product is complete and ready for installation.

Figure 6:
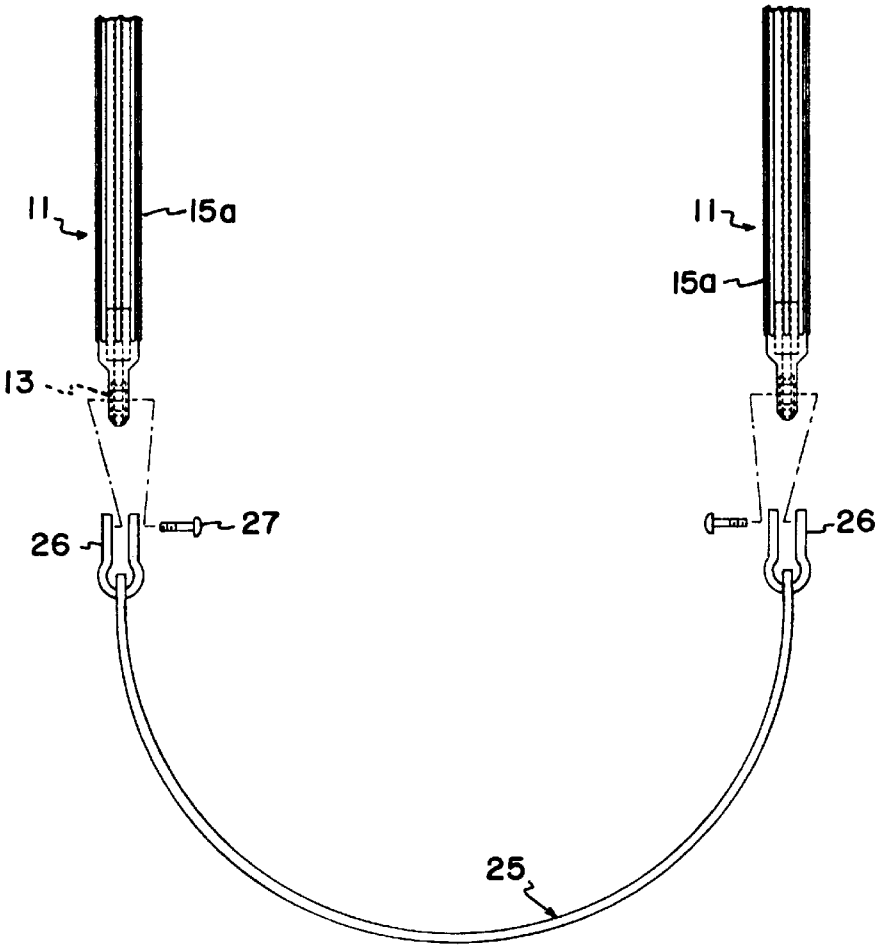
FIG. 6 is a fragmentary front elevational view of the lower end of two of the inventive cables, and swing seat and hardware for connecting the swing seat to each of the lower cable ends.
Figure 5:
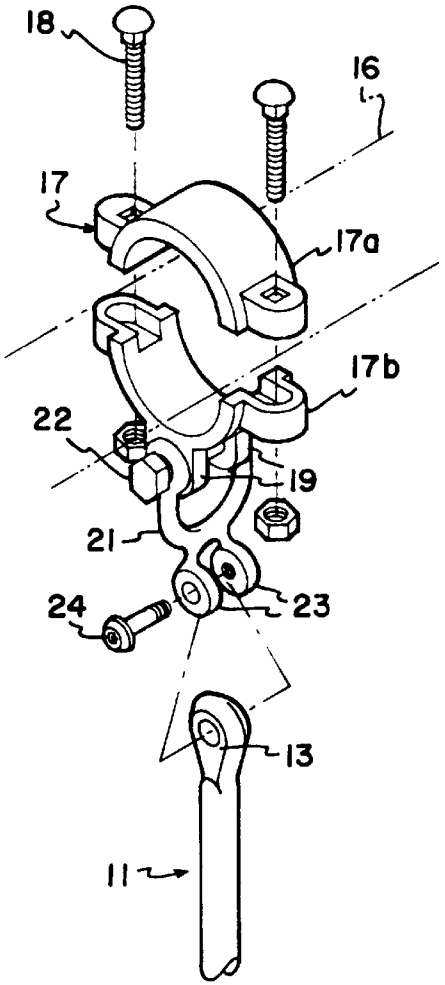
FIG. 5 is an exploded perspective view of hardware used for connecting the inventive cable to an overhead support.

Typical installation appears in FIGS. 5 and 6. FIG. 5 shows the upper end of the cable device 11 and the connecting hardware to an overhead support point. FIG. 6 shows the lower end of two cable devices 11 connected to opposite sides of a swing seat.

With reference to FIG. 5, the upper support point for the swing may be an elevated horizontal member such as a pipe 16. The pipe clamp 17 having upper and lower clamping components are assembled on opposite sides of the pipe 16 and bolted together with nut and bolt assemblies 18. The pipe clamp 17 also includes a pair of tangs 19 to which a clevis 21 is pivotally connected by a bolt 22. The clevis 21 includes a pair of downwardly projecting tangs 23, one of which is internally threaded to receive an Allen bolt 24. Allen bolt 24 projects through the upper bushing 13 of the cable device 11 and suspends it in such a manner that the cable 11 can swing as a pendulum.

With reference to FIG. 6, a flexible swing seat has clevis links 26 pivotally connected at each end. The clevis lengths 26 also have transverse bores at their outer free ends, one of which is formed with an internal thread to receive an Allen bolt 27. As shown, lower bushing 13 fits into the clevis link and is retained by the Allen bolt 27 permitting pivotal movement of the swing seat 25.

Preferably, the length of the handle portion 15*a* of the cable device 11 is at least about 24 inches, which is sufficient to provide a grippable handle for swing users of various ages and sizes. The ribs 15*c* further enhance the ability of the child to hold on during swing operation.

Encapsulating the remaining portions of the swing cable at a lesser or stepped diameter nevertheless provides adequate protection from the elements as well as preventing the exposure of children's hands to cable strands that may occasionally break. Encapsulating the bushings avoids the presentation of sharp surfaces to children while at the same time protecting the bushing from weather elements.

We claim:

1. A device for suspending a playground swing or the like from an overhead support, comprising:

an elongated member taking the form of a stranded steel cable having first and second ends and a transverse configuration of predetermined size, said size being small relative to a user's ability to grip the elongated member, and the elongated member having a tensile strength of sufficient magnitude to safely suspend the swing seat during a range of uses given the size of said transverse configuration;

a first connector conlecting said first end to said overhead support;

a second connector connecting said second end to said swing seat; and a swing handle comprising substantially resilient material molded onto said elongated member and extending from a first point proximate said second connector to at least a second point on the elongated member remote from said second connector, the swing handle having a transverse configuration of a size that is effectively larger than that of the elongated member.

2. The device defined by claim 1, wherein the swing handle is generally circular in cross section.

3. The device defined by claim 2, wherein the swing handle has a diameter of approximately 1 inch.

4. The device defined by claim 3, wherein the swing handle is formed with a plurality of circumferentially spaced elongated ribs extending longitudinally on said handle member.

5. The device defined by claim 2, which further comprises a resilient coating of lesser diameter than said swing handle disposed on substantially the entirety of the remaining length of said elongated member.

6. The apparatus defined by claim 5, wherein the resilient coating is molded onto said elongated member.

7. The apparatus defined by claim 5, wherein said resilient coating encapsulates said first and second connecting means.

8. The device defined by claim 1, wherein the stranded steel cable has a diameter of about 3⁄16 inch.

9. The device defined by claim 1, wherein each of said first and second connectors comprises an annular bushing.

10. The device defined by claim 9, wherein said stranded steel cable has first and second free ends each of which encircles the associated annular bushing, so that said free end lies adjacent to the main body of the steel cable, and the connecting means further comprises a ferrule sized to slide over the free cable and main cable body in retaining relation.

11. The device defined by claim 10, wherein the swing handle is generally circular in cross section.

12. The device defined by claim 11, which further comprises a resilient coating of lesser diameter than said swing handle disposed on substantially the remaining length of said steel cable.

13. The device defined by claim 12, wherein said resilient coating encapsulates substantially the entire remainder of said steel cable and said bushings.

14. A device for suspending a playground swing seat or the like from an overhead support, comprising:

an elongated stranded steel cable having first and second ends and a diameter that is small relative to a user's ability to grip the cable, the cable having a tensile strength of sufficient magnitude to safely suspend the swing seat during a range of uses given the size of its diameter;

a first connector for connecting said first end to said overhead support;

a second connector for connecting said second end to said swing seat; and a swing handle comprising substantially resilient material molded onto said steel cable and extending from a first point proximate said second connector to at least a second point on the steel cable remote from said second connector, the swing handle having a circular cross section of a size that is effectively larger than that of the steel cable.

15. The device defined by claim 14, wherein the first and second connector each comprises an annular bushing, the associated free end of a steel cable encircling said annular bushing so that the free cable end lies adjacent the main body of the cable, and further comprising a ferrule sized to slide over the free cable end and main cable body in retaining relation.

16. The device defined by claim 15, which further comprises a resilient coating of lesser diameter than said swing handle disposed on substantially the remaining length of said steel cable.

17. The device defined by claim 16, wherein said resilient coating encapsulates substantially the entire remainder of said steel cable and said bushings.

18. The device defined by claim 17, wherein said resilient coating is molded onto said steel cable.

19. The device defined by claim 18, wherein the diameter of said steel cable is about ⅜ inch, the diameter of the swing handle is about 1 inch and the diameter of the coated remainder of said cable is about ⅝ inch.

* * * * *